US008558144B2

(12) United States Patent
Perez

(10) Patent No.: US 8,558,144 B2
(45) Date of Patent: Oct. 15, 2013

(54) PET/PEOPLE CANNED FOOD WARMING DEVICE

(76) Inventor: Jackie Habit Perez, Columbia, SC (US)

( * ) Notice: Subject to any disclaimer, the term of this patent is extended or adjusted under 35 U.S.C. 154(b) by 537 days.

(21) Appl. No.: 12/614,429

(22) Filed: Nov. 8, 2009

(65) Prior Publication Data

US 2011/0108544 A1 May 12, 2011

(51) Int. Cl.
*F27D 11/00* (2006.01)

(52) U.S. Cl.
USPC ..... 219/441; 219/448.11

(58) Field of Classification Search
USPC ..... 219/442, 445.1, 446.1, 447.1, 448.13
See application file for complete search history.

(56) References Cited

U.S. PATENT DOCUMENTS 2,576,874 A * 11/1951 Acton ..... 219/387

* cited by examiner

*Primary Examiner* — Cheung Lee
(74) *Attorney, Agent, or Firm* — Oakwood Law Group, LLP; Yuchien Wei

(57) ABSTRACT

A device for warming canned food, particularly pet food, includes a container, a resistive heating element, and a control device. The container has an inner wall and an outer wall; the inner wall is of a thermally conductive material at least at the bottom of the container. The heating element is located between the inner wall and outer wall at the bottom of the container. The control device, connected to the heating element, includes a thermostat effective to control a temperature at the interior floor of the container to approximately 102° F., a temperature suitable for pet food. The control device may also be variable so that the thermostat is effective to control the temperature to approximately 98° F., a temperature suitable for food intended for human consumption.

5 Claims, 3 Drawing Sheets

PET/PEOPLE CANNED FOOD WARMING DEVICE

FIELD OF THE DISCLOSURE

This disclosure relates to a device for warming canned food while it is still in the can, particularly for cats and dogs.

BACKGROUND OF THE DISCLOSURE

Canned pet food is typically stored at room temperature, so that food from a newly opened can is likewise at room temperature. Many times pet owners buy large quantities of canned pet food at once and store said items within their garage. As the seasons change the winter months bring about canned food that in increasingly cold in temperature. Additionally, since an opened can should be refrigerated, food taken from a previously opened can is generally at the refrigerator temperature. In either case, the food when presented to the animal is well below the animal's own body temperature (approximately 102° F. for cats and dogs) and is thus unappealing. This problem, well known to pet owners, is often dealt with by dispensing food from the metal can into a non-metal dish and then heating the dish in a microwave oven. Operating the microwave oven for more than a few seconds generally overheats the pet food. There is thus a need for an easily operated device that can heat pet food while still in the can to an easily controlled temperature.

SUMMARY OF THE DISCLOSURE

The present disclosure provides a device for warming canned food, including a container, a resistive heating element, and a control device. The container has an inner wall and an outer wall; the inner wall is of a thermally conductive material at least at the bottom of the container (the interior floor). The resistive heating element is located between the inner wall and outer wall at the bottom of the container. The control device is connected to the heating element for controlling current in the heating element; the control device includes a thermostat effective to control a temperature of the inner wall at the bottom of the container to approximately 102° F., a temperature suitable for pet food. The control device may also be variable so that the thermostat is effective to control a temperature of the inner wall at the bottom of the container to approximately 98° F., a temperature suitable for food intended for human consumption.

The foregoing has outlined, rather broadly, the preferred features of the present disclosure so that those skilled in the art may better understand the detailed description of the disclosure that follows. Additional features of the disclosure will be described hereinafter that form the subject of the claims of the disclosure. Those skilled in the art should appreciate that they can readily use the disclosed conception and specific embodiment as a basis for designing or modifying other structures for carrying out the same purposes of the present disclosure and that such other structures do not depart from the spirit and scope of the disclosure in its broadest form.

DETAILED DESCRIPTION

Figure 1:
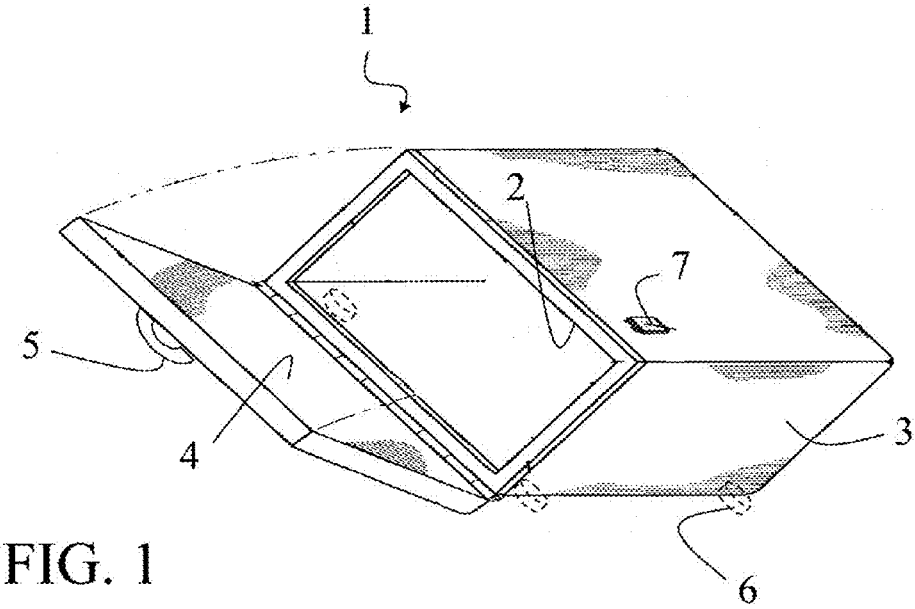
FIG. 1 is a general view of a pet food warming device according to an embodiment of the disclosure.

A pet food warmer according to an embodiment of the disclosure is shown in FIG. 1. The pet food warmer includes a container 1 (typically but not necessarily rectangular in shape) having inner and outer walls 2, 3 and a door 4 hinged along at least part of an edge thereof. The door may have a handle 5; the container may be provided with feet 6. The outer walls 3 are of a durable material (e.g. metal or plastic). The inner walls 2 are of metal (at least at the bottom of the container), preferably with a smooth finish, to conduct and reflect heat in the interior of the container. A control knob 7 is located at a convenient place on the outer wall. The interior of the container is sized so that several cans of food may be placed therein at the same time. In an embodiment, the inside bottom wall, or floor, of the container has a large enough area to fit six 1-lb. cans or nine 5.5-oz. cans.

Figure 2:
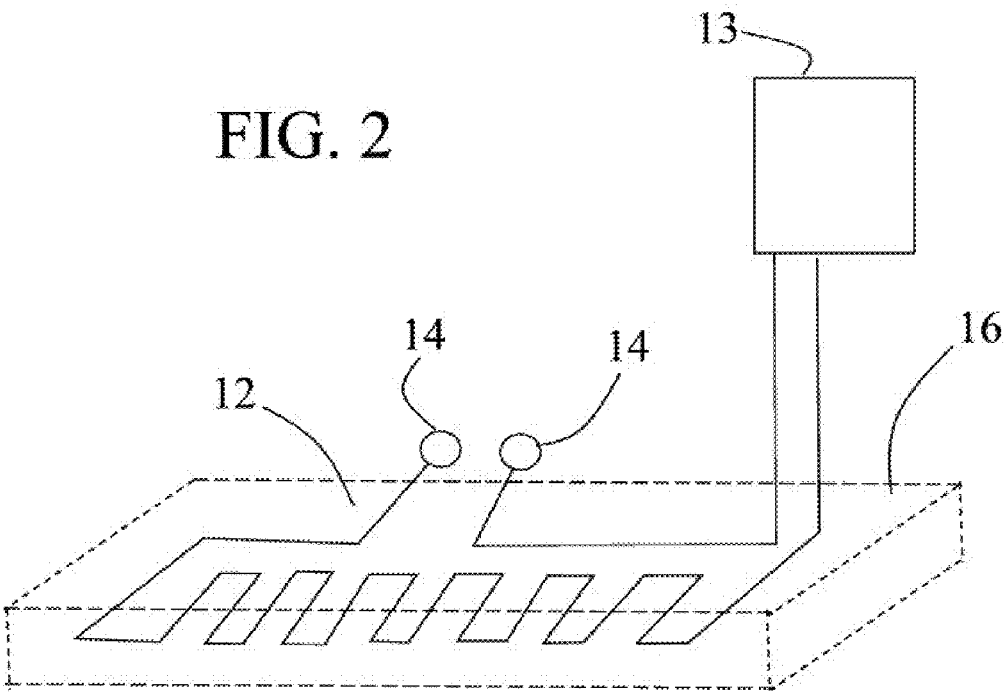
FIG. 2 is an isolated view of a thermostatically controlled heating element between inner and outer bottom walls of the device of FIG. 1.

The cans are placed directly on the floor of the container, so as to be close to a resistive heating element 12 located between the inner and outer bottom walls, as shown in FIG. 2. Heating element 12 has terminals 14 which connect to standard AC power via a conventional power cord (not shown). Heating element 12 is in series with a control device 13, which controls the current in the heating element. Control device 13 may simply be an on/off switch but preferably also includes a thermostat for controlling the temperature at the floor 16 of the container.

Figure 3:
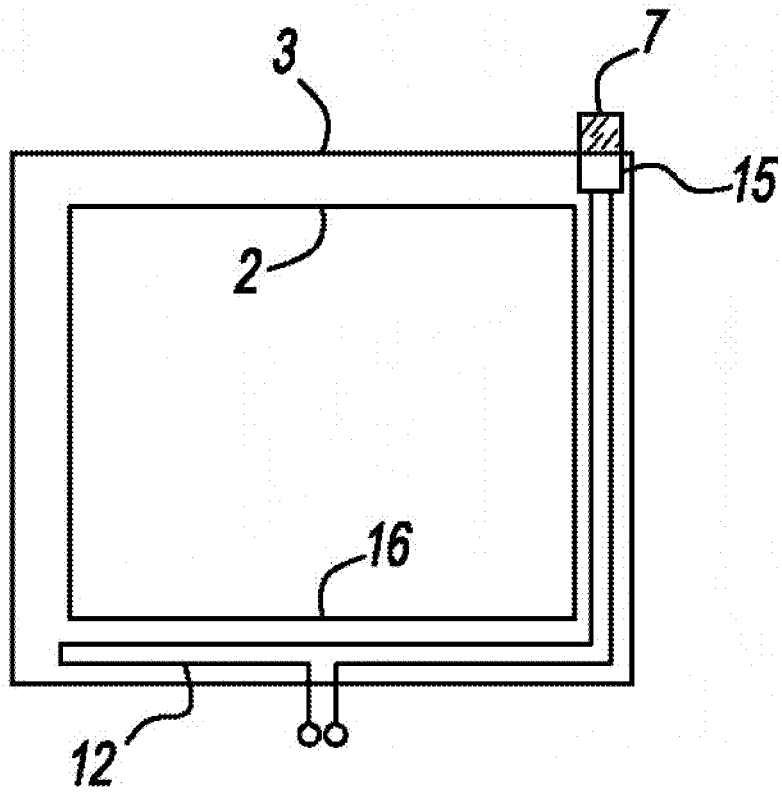
FIG. 3 is a rear cutaway view of the device of FIG. 1, schematically illustrating the heating element and a thermostatic control for the heating element.

As shown schematically in FIG. 3, control device 13 includes thermostat 15 connected to knob 7 at the top of the container. In an embodiment, turning knob 7 from an "off" position to an "on" position causes the heating element to turn on and causes thermostat 15 to automatically control the temperature at floor 16 to approximately 102° F. The variation in temperature is preferably not more than 2° F. (that is, the temperature may vary between 100° F. and 104° F.). The heating element 12 is supported between the inner and outer walls by insulators (not shown). In another embodiment, control device 13 also includes a variable resistor connected to knob 7, so that turning the knob causes the temperature at floor 16 to be continuously varied between room temperature and approximately 102° F.

It will be appreciated that the disclosed food warmer conveniently warms pet food to the animal's body temperature without the need to remove the food from the can. The temperature in the interior of the container is limited so that the food does not overheat. Other items of canned food may also be conveniently warmed. In another embodiment, knob 7 may be set to one of three positions—"off", "people" and "pets"; at the "people" setting, thermostat 15 controls the temperature at the floor of the container to human body temperature (approximately 98° F.) while at the "pets" setting the temperature is controlled to animal body temperature of approximately 102° F.

While the disclosure has been described in terms of specific embodiments, it is evident in view of the foregoing description that numerous alternatives, modifications and variations will be apparent to those skilled in the art. Accordingly, the disclosure is intended to encompass all such alternatives, modifications and variations which fall within the scope and spirit of the disclosure and the following claims.

The invention claimed is:

1. An apparatus for warming canned food, comprising:

a container having an inner wall and an outer wall, the inner wall being of a thermally conductive material at least at a bottom of the container;

a resistive heating element located between the inner wall and outer wall at the bottom of the container; and a control device connected to the heating element for controlling current in the heating element, the control device including a thermostat effective to control a temperature of the inner wall at the bottom of the container to approximately 102° F. which is a suitable temperature for pet food, and an actuator or knob movable from an "off" state to an "on" state corresponding to automatic control of the temperature of the inner wall at the bottom of the container at approximately 102° F.

2. An apparatus according to claim 1, further comprising a door having a handle.

3. An apparatus according to claim 1, wherein the thermostat is effective to control the temperature of the inner wall at the bottom of the container in the range 100° F. to 104° F.

4. An apparatus according to claim 1, wherein the thermostat is also effective to control the temperature of the inner wall at the bottom of the container to approximately 98° F.

5. An apparatus for warming canned food, comprising:

a container having an inner wall and an outer wall, the inner wall being of a thermally conductive material at least at a bottom of the container;

a resistive heating element located between the inner wall and outer wall at the bottom of the container; and a control device connected to the heating element for controlling current in the heating element, the control device including a thermostat effective to control a temperature of the inner wall at the bottom of the container to approximately 98° F. suitable for people food and approximately 102° F. suitable for pet food, wherein the control device includes an actuator movable from an "off" state to a first "on" state and to a second "on" state, the first "on" state corresponding to automatic control of the temperature of the inner wall at the bottom of the container to approximately 98° F., and the second "on" state corresponding to automatic control of the temperature of the inner wall at the bottom of the container to approximately 102° F.

* * * * *